US010886705B2

(12) United States Patent
Yilmaz et al.

(10) Patent No.: US 10,886,705 B2
(45) Date of Patent: Jan. 5, 2021

(54) SPARK PLUG HAVING A CENTER ELECTRODE WITH IMPROVED THERMAL PROPERTIES

(71) Applicant: Robert Bosch GmbH, Stuttgart (DE)

(72) Inventors: Ugur Yilmaz, Asperg (DE); Chris Schimmel, Waiblingen (DE); Helene Kasjanow, Stuttgart (DE); Hermann Kersting, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/464,090

(22) PCT Filed: Oct. 4, 2017

(86) PCT No.: PCT/EP2017/075148

§ 371 (c)(1),
(2) Date: May 24, 2019

(87) PCT Pub. No.: WO2018/095624

PCT Pub. Date: May 31, 2018

(65) Prior Publication Data

US 2019/0296525 A1 Sep. 26, 2019

(30) Foreign Application Priority Data

Nov. 25, 2016 (DE) ..... 10 2016 223 404

(51) Int. Cl.
*H01T 13/16* (2006.01)
*H01T 13/34* (2006.01)
(Continued)

(52) U.S. Cl.
CPC ..... *H01T 13/16* (2013.01); *H01T 13/08* (2013.01); *H01T 13/14* (2013.01); *H01T 13/34* (2013.01)

(58) Field of Classification Search
CPC ..... H01T 13/16; H01T 13/34
See application file for complete search history.

(56) References Cited

U.S. PATENT DOCUMENTS 3,229,144 A * 1/1966 Poland ..... H01T 13/08 313/138
3,278,785 A * 10/1966 Hauth, Jr. ..... H01T 13/38 313/137

(Continued)

FOREIGN PATENT DOCUMENTS

CN 101682174 A 3/2010
DE 126935 C 1/1902

(Continued)

OTHER PUBLICATIONS

International Search Report for PCT/EP2017/075148, dated Jan. 20, 2018.

*Primary Examiner* — Tracie Y Green
(74) *Attorney, Agent, or Firm* — Norton Rose Fulbright US LLP; Gerard Messina

(57) ABSTRACT

A spark plug is described as including an insulator which is situated in a spark plug housing and which has a longitudinal axis and an opening along the longitudinal axis. Furthermore, a center electrode is situated in the opening of the insulator. Furthermore, at least one ground electrode is provided at the spark plug housing. The insulator has a first insulator section and a second insulator section, the first insulator section extending in the direction of the longitudinal axis over a first insulator section length having a first inner diameter. The second insulator section extends in the direction of the longitudinal axis over a second insulator section length having a second inner diameter. Here, the first inner diameter is smaller than the second inner diameter, the first insulator section merging directly into the second insulator section. The center electrode has a center electrode (Continued)

section which extends in the direction of the longitudinal axis over a center electrode section length having a center electrode outer diameter at least over the entire insulator section length of the first insulator section and of the second insulator section.

23 Claims, 4 Drawing Sheets

(51) Int. Cl.
*H01T 13/14* (2006.01)
*H01T 13/08* (2006.01)

(56) References Cited

U.S. PATENT DOCUMENTS 3,742,280 A * 6/1973 Siegle ..... H01T 13/41 313/118
4,136,259 A 1/1979 Djeddah
4,384,234 A * 5/1983 Breit ..... H01T 13/39 313/142
4,798,991 A * 1/1989 Benedikt ..... H01T 13/52 313/131 R
5,239,225 A 8/1993 Moriya et al.
6,341,501 B2 * 1/2002 Sugimoto ..... H01T 13/34 65/32.2
2004/0173588 A1 * 9/2004 Benz ..... H01T 13/39 219/121.64
2007/0290590 A1 * 12/2007 Hoffman ..... C03C 8/04 313/141
2010/0045156 A1 * 2/2010 Menken ..... H01T 13/39 313/141
2013/0293088 A1 * 11/2013 Kuno ..... C22C 19/03 313/141
2014/0361677 A1 * 12/2014 Deguchi ..... H01T 13/40 313/141

FOREIGN PATENT DOCUMENTS

DE 68917573 T2 12/1994
DE 69112330 T2 1/1996
DE 112008002535 T5 8/2010
DE 102013102854 A1 9/2013
JP 2010062160 A 3/2010
JP 2013165016 A 8/2013
WO 2009039478 A2 3/2009

* cited by examiner

SPARK PLUG HAVING A CENTER ELECTRODE WITH IMPROVED THERMAL PROPERTIES

FIELD OF THE INVENTION

The present invention relates to a spark plug having a reduced heat absorption at the center electrode.

BACKGROUND INFORMATION

Spark plugs are known from the related art in various embodiments. One known spark plug includes one center electrode and one ground electrode. The center electrode is situated in an insulator, the insulator being connected to a spark plug housing in a force-fitted manner. An electrically conductive material establishes an electrical connection between the center electrode and an electrical connection area of the spark plug. Spark plugs are used to ignite flammable air/fuel mixtures in a combustion chamber (for example internal combustion engine).

During the operation of the spark plug in an engine, high temperatures occur at the center electrode which facilitate wear of the center electrode. The heat input into the center electrode takes place in two ways. On the one hand, the high temperature of the hot residual gas is transferred to the center electrode upon ignition of the mixture. On the other hand, the heat is transferred from the part of the insulator which protrudes into the combustion chamber into the center electrode. This high heat input into the center electrode protruding into the combustion chamber results in increased heating at the firing tip of the center electrode and thus in undesirably high wear of same.

In order to reduce this high heat transfer from the insulator into the center electrode protruding into the combustion chamber, the heat transport between the insulator and the center electrode is stopped with the aid of a gap. In this way, the center electrode temperature and thus the wear of the firing tip of the center electrode may be reduced.

For example, U.S. Pat. No. 5,239,225 provides a spark plug in which the center electrode is provided with a diameter step. The step provided in the center electrode includes a reduction of the diameter of the center electrode. The diameter of the center electrode, which is reduced by this step, separates the center electrode from the opening of the insulator through a gap. The disadvantage of this embodiment is that the diameter reduction of the center electrode requires complex methods in terms of manufacture (for example chipless by extrusion or chipping by turning). Furthermore, the mechanical stability, in particular the bending resistance, of the center electrode, is reduced by the grading of the center electrode. Moreover, the cross section reduction of the center electrode also results in a reduction of the cross sectional area of the heat-conducting center electrode core, where the heat dissipation of the center electrode is impaired.

Furthermore, the diameter reduction of the center electrode results in a reduction of the cross sectional portion of the heat-conducting center electrode core or in a greater distance of the center electrode core from the front side of the center electrode. These limitations of the center electrode core length and of the center electrode core cross section result in a disadvantageous limitation of the ability of the firing tip to dissipate heat along the center electrode.

Therefore, the need exists to provide a spark plug having a reduced heat input into the center electrode which is manufacturable more cost-effectively and whose center electrode has an increased mechanical stability and an increased heat dissipation along the center electrode.

SUMMARY

The spark plug according to the present invention has the advantages that it is low-wear due to the reduced heat input into the center electrode and the high heat dissipation along the center electrode, and that it includes a center electrode having a high mechanical stability and is manufacturable cost-effectively.

According to the present invention, a spark plug is provided for this purpose including an insulator which is situated in a spark plug housing and which has a longitudinal axis and an opening along the longitudinal axis. Furthermore, a center electrode is situated in the opening of the insulator. At least one ground electrode is situated at the spark plug housing of the spark plug.

The insulator includes a first insulator section and a second insulator section. The opening of the insulator having a first essentially constant inner diameter of an essentially cylindrical opening extends over the first insulator section having a first insulator section length in the direction of the longitudinal axis. Having a second essentially constant inner diameter of an essentially cylindrical opening, the opening of the insulator extends over the second insulator section having a second insulator section length in the direction of the longitudinal axis. An essentially constant inner diameter is in the present case an inner diameter which varies by maximally 10% within the indicated range. An essentially cylindrical opening is in the present case a cylindrical opening which deviates from an ideal cylinder by maximally 10% of the diameter within the indicated range.

In this case, the first inner diameter of the opening of the insulator is smaller than the second inner diameter of the opening of the insulator. The first insulator section merges directly into the second insulator section in a transition. The expansion of the transition in the longitudinal direction of the insulator from the first insulator section into the second insulator section is in this case considerably smaller than the second section length of the second insulator section in the longitudinal direction of the insulator. The transition may be implemented in such a way that the inner diameter of the insulator in the area of the transition is not smaller than the first inner diameter of the first insulator section and not greater than the second inner diameter of the second insulator section.

Furthermore, the center electrode is situated in the opening of the isolator. The center electrode has a center electrode section having a section length in the direction of the longitudinal axis and an outer diameter of the center electrode, the center electrode section extending at least over the entire section length of the first insulator section length and of the second insulator section length. Here, it is advantageous that the reduction of the heat input of the center electrode from the insulator is achieved due to the enlarged second inner diameter along the second insulator section length. This presents the possibility of designing the center electrode to have an essentially constant outer diameter at least in the area of the first insulator section length and of the second insulator section length. An essentially constant outer diameter is in the present case an outer diameter which varies by maximally 10% within the indicated range. This, in turn, has the advantage that the center electrode is manufacturable at minor production expenditures. It is furthermore advantageous that the mechanical stability, in particular the bending resistance, of the center electrode is improved.

The center electrode is advantageously joined by a gap, which varies between at least 40 μm and/or maximally 120 μm within the indicated range, in the area of the first insulator section length in the first insulator section. This gap has the advantage that the center electrode may be joined into the insulator at minor production expenditures.

It is furthermore advantageous that the center electrode in the first insulator section may be connected to the insulator by a glass melt at least sectionally on the first insulator section length. Due to this connection of the center electrode to the insulator, a thermal connection is established at least in the subareas of the first insulator section, which are connected by the glass melt, in addition to the mechanical fastening and the gas-tight closure. This allows for heat to be dissipated via the insulator from the center electrode into the spark plug housing at least in one subarea of the first insulator section.

It is furthermore advantageous that the radial distance between the insulator and the center electrode is at least 100 μm and maximally 500 μm in the second insulator section. A circular gap designed in this way between the center electrode and the insulator results in a thermal decoupling which particularly reliably prevents the center electrode from being heated up by the insulator. The radial distance may be generated with the aid of an additional bore of the insulator in the longitudinal direction of the insulator having a correspondingly greater diameter.

It is particularly advantageous that the second insulator section having the enlarged opening of the insulator for the purpose of forming the gap between the center electrode and the insulator has an insulator section length of at least 0.5 mm and/or maximally 10 mm. This type of an insulator section length of the second insulator section ensures an effective thermal decoupling by the gap.

It is furthermore advantageous that the first insulator section is situated on the side of the second insulator section which faces away from the combustion chamber. In this way, it is ensured that the center electrode is isolated on the side facing the combustion chamber and the heat is dissipated on the side of the center electrode section facing away from the combustion chamber.

It is particularly advantageous that the expansion of the inner opening of the insulator is compensated for at least sectionally in the area of the second insulator section by enlarging the outer diameter. It is possible to fully or partially maintain the thermal and mechanical properties of the insulator by enlarging the outer diameter.

It is furthermore advantageous that the center electrode section at the end of the spark plug on the combustion chamber side extends beyond the second insulator section of the opening of the insulator.

A center electrode core, which is surrounded by a center electrode sheath, advantageously extends at least along the longitudinal extension of the center electrode section of the center electrode. Here, the material of the center electrode core has a higher thermal conductivity than the material of the center electrode sheath. At the point of transition from the first insulator section to the second insulator section, the center electrode core has a portion of the cross sectional area of the center electrode of up to 60%. This makes it possible to additionally advantageously improve the thermal conductivity of the center electrode core and thus the heat dissipation capability of the firing tip along the center electrode.

It is particularly advantageous that the center electrode core of the center electrode has a portion of the cross sectional area of the center electrode of up to 70% at a distance of 5 mm from the end of the center electrode section facing the combustion chamber.

It is particularly advantageous that the distance of the center electrode core from the end of the center electrode section facing the combustion chamber is maximally 2.25 mm. This advantageously allows for a very favorable heat dissipation of the center electrode which results in an increased service life of the spark plug.

It is particularly advantageous that the second insulator section extends up to the one front side of the insulator. This advantageously allows for a robust manufacture.

Advantageously, the opening of the insulator at the end of the insulator on the combustion chamber side has an at least partially conical design in a third insulator section which is directly adjacent to the second insulator section. The at least partially conical expansion of the opening of the insulator results in a gap, which changes over a third section length of the third insulator section, between the insulator and the center electrode. The distance from the center electrode is thus enlarged even more at the end of the insulator which is particularly strongly thermally stressed and a further temperature reduction at the firing tip of the center electrode as well as an increased service life of the spark plug is achieved.

It is advantageous that the third insulator section extends in the direction of the longitudinal axis over a third isolation section length.

It is furthermore advantageous that the center electrode section extends at least over the entire section length including the first insulator section length of the first insulator section, the second insulator section length of the second insulator section, and the third insulator section length of the third insulator section.

It is furthermore advantageous that the center electrode section at the end of the spark plug on the combustion chamber side extends over and beyond the third insulator section length of the third insulator section of the opening of the insulator.

It is particularly advantageous that the third insulator section extends up to the front side of the insulator. This advantageously allows for a robust manufacture.

It is particularly advantageous that the radial wall thickness of the insulator is largely constant along the at least partially conical expansion of the inner opening of the insulator in the area of the third insulator section length of the third insulator section. A largely constant wall thickness is in the present case a wall thickness in a plane perpendicular to the longitudinal axis of the spark plug which varies by maximally 10% within the indicated range. It is possible to fully or partially maintain the thermal and mechanical properties of the insulator by enlarging the outer diameter.

Further features and advantages of the present invention are apparent to those skilled in the art from the following description of exemplary specific embodiments, which are, however, not to be construed as limiting to the present invention, with reference to the appended drawings.

DETAILED DESCRIPTION

Figure 1:
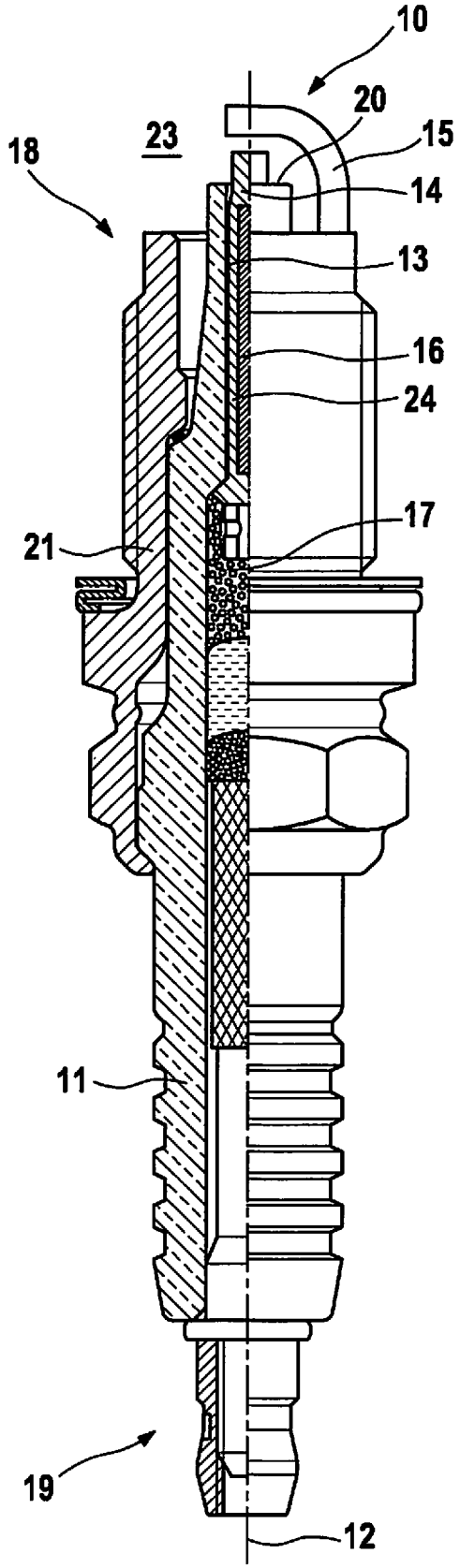
FIG. 1 shows a schematic representation of a spark plug known from the related art.

According to the exemplary embodiments of the present invention, all figures are merely schematic representations of the devices or their components according to the present invention. In particular, distances and relations of magnitude are not represented every time true to scale in the figures. Corresponding elements are provided with identical reference numerals in the different figures.

DETAILED DESCRIPTION OF THE INVENTION

In FIG. 1, a schematic representation of a spark plug 10 known from the related art is shown including an insulator 11, a spark plug housing 21, a longitudinal axis 12, an opening 13 of insulator 11, a center electrode 14 including an inner center electrode core 16, and an outer center electrode sheath 24 as well as at least one ground electrode 15.

Here, insulator 11 is situated in spark plug housing 21. Opening 13 is provided in insulator 11 along longitudinal axis 12. Center electrode 14 is situated in the longitudinal direction of insulator 11 in essentially cylindrical opening 13 of insulator 11 in such a way that center electrode 14 is electrically insulated against spark plug housing 21 by insulator 11 and a thermal conduction from center electrode 14 into spark plug housing 21 is possible via insulator 11. Center electrode 14 includes inner center electrode core 16, the material of center electrode core 16 having a higher thermal conductivity than the material of center electrode sheath 24 which surrounds center electrode core 16. A favorable thermal conduction is thus made possible along center electrode 14.

Ground electrode 15 is situated at an end of spark plug 10 on combustion chamber side 18 and connected to spark plug housing 21.

The ignition energy is induced into spark plug 10 via a connection side 19 of spark plug 10. The applied high voltage generates an electric spark, which is suitable to ignite the air/fuel mixture present in the combustion chamber, at the end of spark plug 10 on combustion chamber side 18 between center electrode 14 and ground electrode 15.

In addition, for a long service life of spark plug 10, favorable heat dissipation is necessary from center electrode 14 into insulator 11 and from ground electrode 15 and from insulator 11 into spark plug housing 21. The temperatures reached at center electrode 14 and ground electrode 15 determine the service life of spark plug 10 to a considerable extent. A higher temperature at center electrode 14 and ground electrode 15 results in increased wear at center electrode 14 and ground electrode 15 and thus in a reduced service life of spark plug 10.

Figure 2:
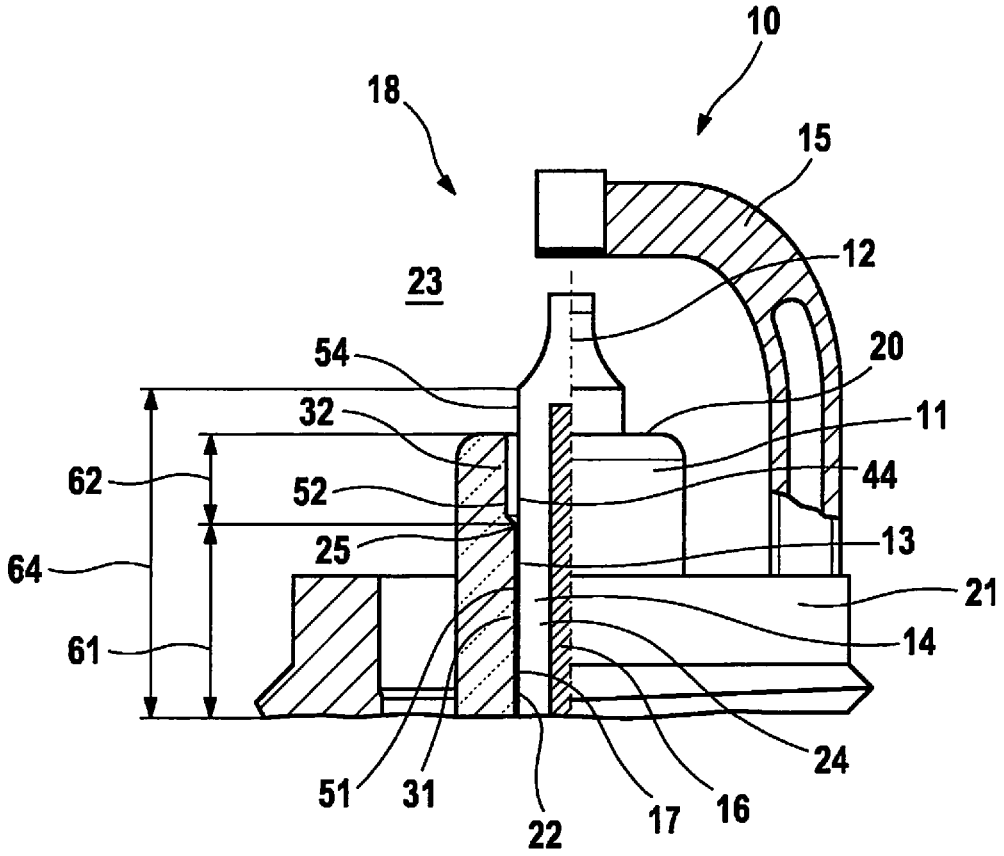
FIG. 2 shows a schematic representation of the combustion chamber side of a spark plug according to a first specific embodiment of the present invention.

The schematic representation shown in FIG. 2 shows the section on combustion chamber side 18 of a first specific embodiment of the present invention. Identical elements with reference to FIG. 1 are identified with identical reference numerals and are not elucidated in greater detail.

According to the present invention, opening 13 is implemented in the longitudinal direction of insulator 11 in an essentially cylindrical first insulator section 31 which has a first insulator section length 61 having a first essentially constant inner diameter 51 and in an essentially cylindrical second insulator section 32 which is directly adjacent thereto and has a second insulator section length 62 having an essentially constant second inner diameter 52. First inner diameter 51 of opening 13 of insulator 11 is smaller than second inner diameter 52 of opening 13 of insulator 11.

First insulator section 31 merges directly into second insulator section 32. The expansion of a transition 25 in the longitudinal direction of the insulator from first insulator section 31 into second insulator section 32 is in this case considerably smaller than second insulator section length 62 of second insulator section 32 in the longitudinal direction of the insulator. The inner diameter of insulator 11 in the area of transition 25 is not smaller than first inner diameter 51 of first insulator section 31 and not greater than second inner diameter 52 of second insulator section 32. Second insulator section 32 extends on combustion chamber side 18 of insulator 11 on an insulator section length 62 up to a front side 20 of insulator 11.

Furthermore, a center electrode 14 is situated in opening 13 of insulator 11. Center electrode 14 includes a center electrode section 44 having a center electrode section length 64 in the longitudinal direction having a center electrode outer diameter 54 of center electrode 14, center electrode section 44 extending at least over the entire length of first insulator section length 61 of first insulator section 31 and of second insulator section length 62 of second insulator section 32.

Center electrode core 16 is embedded in a center electrode sheath 24. In the present exemplary embodiment, center electrode core 24 has a portion of the cross sectional area of 40% at the point of transition 25 from first insulator section 31 to second insulator section 32. The portion of center electrode core 24 of the cross sectional area of center electrode 14 may reach up to 60% at the point of transition 25 from first insulator section 31 to second insulator section 32. In the present exemplary embodiment, center electrode core 24 has a portion of the cross sectional area of 20% at a distance of 5 mm from end of center electrode section 44 facing combustion chamber 23. The portion of center electrode core 24 of the cross sectional area of center electrode 14 may reach up to 70% at a distance of 5 mm from the end of center electrode section 44 facing combustion chamber 23. The distance of center electrode core 16 from the end of center electrode section 44 facing the combustion chamber is maximally 2.25 mm.

In first insulator section 31 of opening 13 of insulator 11, center electrode 14 is joined by a narrow gap 22 and connected at least partially via a glass melt 17. The width of this gap 22 is at least 40 μm and/or maximally 120 μm. This connection between insulator 11 and center electrode 14 via glass melt 17 is also used to dissipate the heat from center electrode 14 via insulator 11 into spark plug housing 21.

In order to reduce the heat absorption of center electrode 14 from the part of insulator 11 on the combustion chamber side, opening 13 of insulator 11 is expanded in insulator section 32 by an additional bore. This results in a gap in insulator section 32 between insulator 11 and center electrode 14 which is implemented in center electrode section 44 having an essentially constant diameter. The width of this gap is at least 100 μm and/or maximally 500 μm. The length of this gap is at least 0.5 mm and/or maximally 10 mm in the longitudinal direction of the center electrode.

Figure 3:
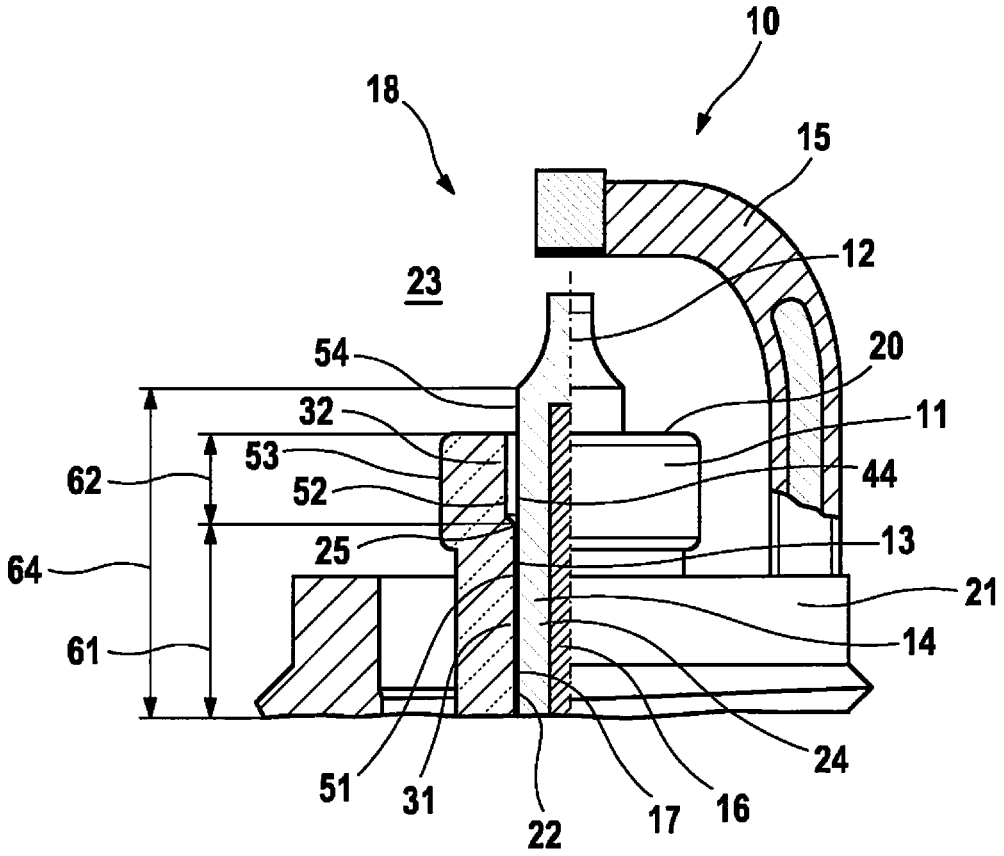
FIG. 3 shows a schematic representation of the combustion chamber side of a spark plug according to a second specific embodiment of the present invention.

FIG. 3 shows in a schematic representation the section 18 on the combustion chamber side in a second specific embodiment of the present invention which is different from the first specific embodiment essentially in that the expansion of opening 13 in insulator section 32 is fully or partially compensated for by an enlarged insulator outer diameter 53. Identical elements with reference to FIGS. 1 and 2 are identified with identical reference numerals and are not elucidated in greater detail.

According to the present invention, the expansion of insulator outer diameter 53 of insulator 11 in insulator section 32 is essentially implemented in such a way that the expansion of opening 13 in insulator section 32 is compensated for.

Figure 4:
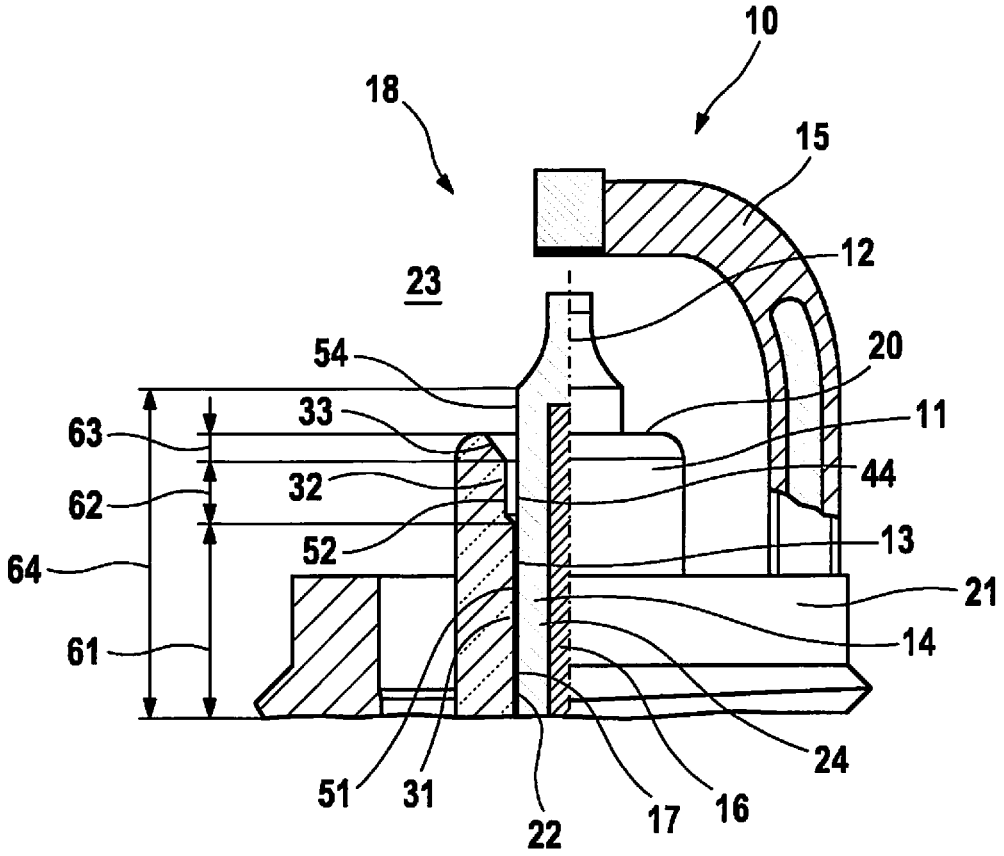
FIG. 4 shows a schematic representation of the combustion chamber side of a spark plug according to another specific embodiment of the present invention.

The schematic representation of the third specific embodiment of the present invention shown in FIG. 4 shows an expansion of opening 13 of insulator 11 which has an at least partially conical design in a third insulator section 33 which is directly adjacent to the second insulator section and extends up to front side 20 of insulator 11.

Identical elements with reference to FIGS. 1, 2, and 3 are identified with identical reference numerals and are not elucidated in greater detail.

The at least partially conical expansion of opening 13 leads to a gap, which changes over a section length 63, between insulator 11 and center electrode 14. The distance from center electrode 14 is thus enlarged even more at the particularly hot end of insulator 11 and a further temperature reduction at the firing tip of center electrode 14 is achieved.

What is claimed is:

1. A spark plug, comprising:

a housing;

an insulator situated in the housing, the insulator including a longitudinal axis and an opening along the longitudinal axis;

a central electrode situated in the opening of the insulator; and at least one ground electrode provided at the housing, wherein:

the insulator includes a first insulator section and a second insulator section;

the first insulator section extends in a direction of the longitudinal axis over a first insulator section length having a first inner diameter;

the second insulator section extends in the direction of the longitudinal axis over a second insulator section length having a second inner diameter;

the first inner diameter is smaller than the second inner diameter;

the first insulator section merges directly into the second insulator section in a transition;

the center electrode includes a center electrode section that extends in the direction of the longitudinal axis over a center electrode section length having a center electrode outer diameter;

the center electrode section extends at least over an entire insulator section length of the first insulator section and of the second insulator section; and one or more of the following five features:

(1) the center electrode in the first insulator section is connected at least sectionally to the insulator by a glass melt that (a) is arranged between the center electrode and the insulator at least at an end face of the housing at which the at least one ground electrode is provided and/or (b) fills a gap, no greater than 120 μm, that separates the center electrode from the insulator;

(2) the center electrode has at least sectionally along a longitudinal extension of the center electrode a center electrode core of a first material that extends from inside the insulator to out of the insulator and is embedded in a center electrode sheath of a second material that has a lower thermal conductivity than the first material and that extends from within the insulator to outside of the insulator through the opening to beyond an end of the center electrode core;

(3) the second insulator section has at least sectionally a second outer diameter that is greater than a first outer diameter of the first insulator section; and (4) on a combustion chamber side of the second insulator section, the second insulator section merges into a third insulator section having an inner diameter that is different than the second inner diameter.

2. The spark plug as recited in claim 1, wherein in the first insulator section, the center electrode has a radial distance of at least one of at least 40 μm and maximally 120 μm from the insulator.

3. The spark plug as recited in claim 1, wherein the center electrode in the first insulator section is connected at least sectionally to the insulator by the glass melt that (a) is arranged between the center electrode and the insulator at least at the end face of the housing at which the at least one ground electrode is provided and/or (b) fills the gap, no greater than 120 μm, that separates the center electrode from the insulator.

4. The spark plug as recited in claim 1, wherein in the second insulator section, the center electrode has a radial distance of at least one of at least 100 μm and maximally 500 μm from the insulator.

5. The spark plug as recited in claim 1, wherein the second insulator section length of the second insulator section is at least one of at least 0.5 mm and maximally 10 mm.

6. The spark plug as recited in claim 1, wherein the first insulator section is situated on a side of the second insulator section that faces away from a combustion chamber.

7. The spark plug as recited in claim 1, wherein the second insulator section has at least sectionally the second outer diameter that is greater than the first outer diameter of the first insulator section.

8. The spark plug as recited in claim 1, wherein the center electrode section extends beyond the second insulator section on the combustion chamber side.

9. The spark plug as recited in claim 1, wherein the center electrode has at least sectionally along the longitudinal extension of the center electrode the center electrode core of the first material that is surrounded by the center electrode sheath of the second material that has the lower thermal conductivity than the first material, and the center electrode core has a portion of a cross sectional area of the center electrode of up to 60% at the point of the transition from the first insulator section to the second insulator section.

10. The spark plug as recited in claim 9, wherein the center electrode core has a portion of the cross section of the center electrode of up to 70% at a distance of 5 mm from the end of the center electrode section facing a combustion chamber.

11. The spark plug as recited in claim 9, wherein a distance of the center electrode core from an end of the center electrode section facing a combustion chamber is maximally 2.25 mm.

12. The spark plug as recited in claim 1, wherein:

the insulator has a front side on the combustion chamber side, and the second insulator section extends up to the front side of the insulator.

13. The spark plug as recited in claim 1, wherein the center electrode has, at least sectionally along the longitudinal extension of the center electrode, the center electrode core of the first material that extends from inside the insulator to out of the insulator and is embedded in the center electrode sheath of the second material that has the lower thermal conductivity than the first material and that extends from within the insulator to outside of the insulator through the opening to beyond the end of the center electrode core.

14. The spark plug as recited in claim 1, wherein, at a mouth of the opening, an interior wall of the insulator forming the opening is conical.

15. The spark plug as recited in claim 1, wherein, on the combustion chamber side of the second insulator section, the second insulator section merges into the third insulator section having the inner diameter that is different than the second inner diameter.

16. The spark plug as recited in claim 3, wherein the glass melt is arranged between the center electrode and the insulator at least at the end face of the housing at which the at least one ground electrode is provided.

17. The spark plug as recited in claim 3, wherein the glass melt fills the gap, no greater than 120 μm, that separates the center electrode from the insulator.

18. The spark plug as recited in claim 15, wherein the opening of the insulator is conical at least sectionally in the third insulator section.

19. The spark plug as recited in claim 18, wherein the third insulator section extends in the direction of the longitudinal axis over a third insulator section length.

20. The spark plug as recited in claim 19, wherein the center electrode section of the center electrode extends at least over an entire first insulator section length of the first insulator section, over an entire second insulator section length of the second insulator section, and over an entire third insulator section length of the third insulator section.

21. The spark plug as recited in claim 19, wherein the center electrode section extends over and beyond the third insulator section on the combustion chamber side.

22. The spark plug as recited in claim 19, wherein the third insulator section extends up to a front side of the insulator.

23. The spark plug as recited in claim 19, wherein a wall thickness of the insulator does not vary within the third insulator section by more than 10%, and the wall thickness is a radial wall thickness of the third insulator section in a plane perpendicular to a longitudinal axis of the spark plug.

* * * * *